United States Patent [19]

Tsukimoto

[11] Patent Number: 4,971,311

[45] Date of Patent: Nov. 20, 1990

[54] FEEDER FOR SHEET-FEED PRINTING MACHINE

[75] Inventor: Hideaki Tsukimoto, Toride, Japan

[73] Assignee: Komori Printing Machinery Co., Ltd., Tokyo, Japan

[21] Appl. No.: 247,951

[22] Filed: Sep. 22, 1988

[30] Foreign Application Priority Data

Sep. 24, 1987 [JP] Japan ..... 62-237502
Sep. 24, 1987 [JP] Japan ..... 62-144489[U]
Sep. 24, 1987 [JP] Japan ..... 62-144490[U]

[51] Int. Cl.[5] ..... B65H 7/02; B65H 9/12

[52] U.S. Cl. ..... 271/227; 271/241; 271/152; 271/157; 271/248

[58] Field of Search ..... 271/147, 152, 155, 157, 271/227, 241, 248–256; 414/113

[56] References Cited

U.S. PATENT DOCUMENTS

| | | | |
|---|---|---|---|
| 2,815,209 | 12/1957 | Gulick | 271/157 |
| 4,155,544 | 5/1979 | Scott | 271/265 |
| 4,273,323 | 6/1981 | Kaneko et al. | 271/157 |
| 4,635,924 | 1/1987 | Pollich | 271/241 |
| 4,765,606 | 8/1988 | Marass | 271/157 |
| 4,811,939 | 3/1989 | Keith | 271/227 |

FOREIGN PATENT DOCUMENTS

| | | | |
|---|---|---|---|
| 62-46838 | 2/1987 | Japan | 271/258 |

*Primary Examiner*—H. Grant Skaggs
*Assistant Examiner*—Steven Reiss
*Attorney, Agent, or Firm*—Rosen, Dainow & Jacobs

[57] ABSTRACT

A feeder for use in a sheet-feed printing machine, in which, while a pile board loaded with a paper sheet pile on a pallet is moved upward, paper sheets are fed to the printing unit through a side register lay, comprising a sensor movable along a threaded shaft according to the rotation of the threaded shaft to detect a side edge of the paper sheet pile, which is moved an amount equal to the distance in the cross or lateral direction between a position at which the paper sheet pile is to be positioned when a left-pulling side register lay is used and a position at which the paper sheet pile is to be positioned when a right-pulling side register lay is used, and further comprising a non-interrupting paper replenishing device to insert another paper sheet pile under the paper sheet pile, or detecting means to detect the remaining amount of paper sheets and the top surface of the paper sheet pile.

9 Claims, 7 Drawing Sheets

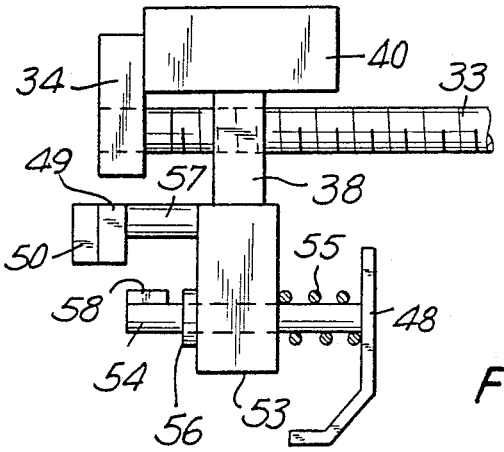
FIG. 4
FIG. 5a
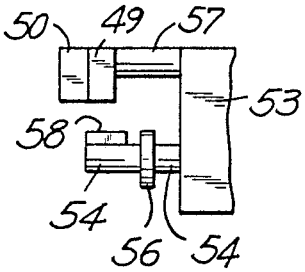
FIG. 5b
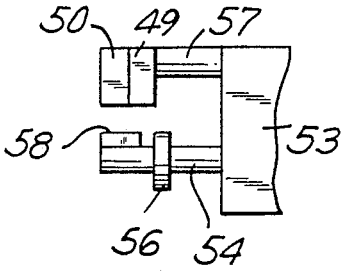
FIG. 6a
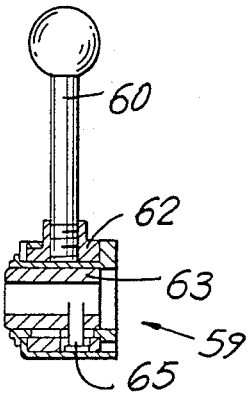
FIG. 6b
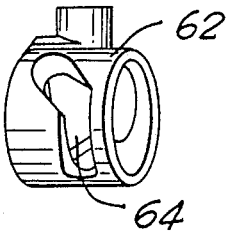

FEEDER FOR SHEET-FEED PRINTING MACHINE

BACKGROUND OF THE INVENTION

This invention relates to a feeder for a sheet-feed printing machine, more specifically, to an improvement of a device for registering side edges of a paper sheet pile in a feeder to control the position of paper sheets perpendicular to the feed direction by pulling the paper sheets to the right or left using a side register lay, which provides continuous paper feed from a paper sheet pile, and is designed to prevent a sensor unit for detecting the position of side edges of the paper sheet pile from malfunction or being damaged.

In the printing operation using a sheet-feed printing machine, paper sheets stacked on a pile board on a pallet are sucked sheet by sheet from the top of the pile by a sucker onto a feedboard and, after the positions of the leading edge and one side edge in the cross direction (left edge or right edge) are controlled by a front register lay and a side register lay, respectively each sheet is gripped by the claws of a swing device and is fed to a printing unit, where an image formed on a printing plate surface of a plate cylinder is transferred directly or through a blanket cylinder to the paper sheets, thus achieving a predetermined printing operation.

FIG. 1 is a schematic plan view showing the conditions of paper sheets in various parts of a feeder, a side register lay, and a plate cylinder of a sheet-feed printing machine of this type. In the figure, numeral 1 indicates paper sheets. Specifically, paper sheets 1*a* indicates those which are stacked on a pile board 3 of a feeder 2 through a pallet 4, paper sheets 1*b* indicates those of which an edge (left edge in the figure) is being controlled by a gauge 6 of a side register lay 5 provided at the front end of a feedboard, and paper sheets 1*c* indicate those which are being printed by a printing plate 8 mounted on the peripheral surface of a plate cylinder 7.

Of these components, the side register lay 5, as shown in FIG. 2 which is a schematic front view of the unit as viewed from the feeder 2, has upper and lower rollers 9 and 10 which rotate in the vicinity of the gauge 6. Paper sheet 1 is picked up at its edge (left edge in the figure) by the rotating rollers 9 and 10 and contacted against the gauge 6 to register its edge. At this time, the amount of pulling distance of the paper sheet 1 is normally set to 5–6 cm by the side register lay 5. Therefore, the paper sheet 1 fed to the side register lay 5 can be picked up if the distance between the edge of the paper and the gauge 6 is approximately 6 cm. If the above distance is too large, the paper edge cannot be picked up between the rollers 9 and 10. If the above distance is too small, the edge of the paper sheet picked up by the rollers 9 and 10 and contacted against the gauge 6 is bent.

Therefore, when transporting the paper sheet 1 from the feeder 2, to pick up the paper sheet 1 by the side register lay 5 and to contact the edge of the paper sheet 1 normally against the gauge 6, the right edge or left edge of the paper sheet pile stacked on the pallet 4 must be positioned so that the distance between the gauge 6 and the paper edge is within a predetermined range (for example, approximately 6 cm as described above).

For this purpose, the feeder 2 has a device (not shown) for positioning the side edge of the paper sheet pile. This device can be one of a variety of types which, in general, has a lay plate to contact against a side edge of the paper sheet pile and a sensor to detect whether or not the paper sheet pile contacts against the lay plate properly. Specifically, with the type (size) of the paper sheet 1 set, the lay plate moves to the right or left together with the sensor according to the rotation of the threaded shaft to a predetermined position (a position at which one side edge of the paper sheet 1 is positioned so that the paper sheet 1 is normally picked up by the side register lay 5).

The side register lay used in the sheet-feed printing machine includes a left-pulling type and a right-pulling type. The left-pulling type, as shown in FIG. 2, grips the left edge of the paper sheet 1 by the rollers 9 and 10 to move the paper sheet 1 to the left and causes the paper sheet 1 to come in contact against the left-end gauge 6, thereby controlling the position of the paper sheet 1. The right-pulling type, in contrast, grips the right edge of the paper sheet 1 to move it to the right and causes it to come in contact, thereby controlling the position of the paper sheet 1.

The feeder of the prior art sheet-feed printing machine has two of the above-described unit to register the edge of the paper sheet pile according to the left-pulling and right-pulling side register lays, a left-pulling unit to register the left edge of the paper sheet pile and a right-pulling unit to register the right edge of the paper sheet pile. In the left-pulling positioning unit, the paper sheet 1 is positioned at a predetermined position so that it is at the right, as viewed from the feeder 2, of the paper sheet 1*b* which is positioned by the side register lay 5 and, in the right-pulling positioning unit, the paper sheet 1 is positioned so that it is at the left, as viewed from the same direction, of the paper sheet 1*b* positioned by the side register lay.

The use of both the left-pulling and right-pulling side register lays 5 is useful for two-sided printing of one paper sheet 1. In this case, if the left-pulling unit is used for the front side printing, the right-pulling unit is to be used for the backside printing. This is to cause one and the same edge of the paper to come in contact against the gauge 6 of the side register lay 5.

However, the prior art technology is defective in that the feeder 2 is provided with two side edge positioning units a left-pulling and right-pulling side register lays 5, which results in complex structure and an increased number of parts.

Moreover, the above-described prior art feeder having the device for positioning the side edges in the cross direction has not been provided with a non-stop device. Therefore, it has not been able to perform paper feed over a plurality of paper sheet piles without interruption.

Further, in the above-described feeder 2, the pile board 3 is moved up as the paper sheets 1 are fed to the printing machine and, when the paper sheets 1 on the pallet 4 are fed out, the pile board 3 is moved down to the lower limit position, where the pile board 3 is loaded with a new paper sheet pile. After that, the pile board 3 is moved up so that the top surface of the paper sheet pile comes up to the paper feed position.

However, when the pile board 3 is moved up with the new paper sheet pile, if the paper sheet pile is skewed and its side edge is not out of the way of sensor unit, the sensor will be pushed up by the top surface of the paper sheet pile. If that occurs, the sensor unit will not be able to detect the side edge of the pile and the sensor unit can also be damaged.

SUMMARY OF THE INVENTION

With a view to obviate the prior art defects of feeders for printing machines, it is a first object of the present invention to provide a feeder for a printing machine, which is adapted for use with either a left-pulling side register lay or a right-pulling side register lay by a single unit.

A second object of the present invention is to provide a feeder for a printing machine, which can automatically control the position of an edge in the cross direction of a paper sheet pile and enables non-stop paper feed operation.

A third object of the present invention is to provide a feeder for a printing machine, which provides positive operation of a sensor unit to detect the side edge of a paper sheet pile and prevents the sensor unit from damaging.

In accordance with the present invention which attains the above objects, there is provided a feeder for a sheet-feed printing machine having a pallet on a pile board loaded with a paper sheet pile movable to the right and left in a direction cross or lateral to the feed direction of paper sheets, to feed the paper sheets, moving up the pile board, to a printing unit through a side register lay, comprising a threaded shaft extending in the cross direction, a first sensor movable along the threaded shaft in response to the rotation of the threaded shaft to detect an edge in the cross or lateral direction of the paper sheet pile, and a moving mechanism to move the sensor together with the threaded shaft in the cross or lateral direction a distance between a position at which the paper sheet pile is to be positioned when a left-pulling side register lay is used and a position at which the paper sheet pile is to be positioned when a right-pulling side register lay is used, and further comprising paper sheet position adjusting means for moving the pallet on the pile board right and left in the cross or lateral direction in response to a detection signal from the first sensor to adjust the lateral position of the paper sheets, a non-stop or non-interrupting paper replenishing device for moving up a rod inserted under the bottom surface of the paper sheet pile through a groove of the pallet and loaded on a bar, a second sensor for detecting insertion of the rod, and control means for interrupting operation of the paper sheet position adjusting means while the second sensor is detecting insertion of the rod, or further comprising a remaining paper sheet detecting sensor for detecting reduction in amounts of remaining paper sheets on the pile board, a pile top surface detecting sensor for detecting, as the pile board loaded with a new paper sheet pile is moving up, the top surface of the new paper sheet pile reaching a pick-up position, and control means for controlling rotation of the threaded shaft so that, when the remaining paper sheet detecting sensor detects reduction in amounts of paper sheets, the first sensor is separated from the side edge of the paper sheet pile and that, when the pile top surface detecting sensor detects that the top surface of the new paper sheet pile reaches the pick-up position, the first sensor is moved to a position where the sensor can detect the side edge of the paper sheet pile.

BRIEF DESCRIPTION OF THE DRAWINGS

FIG. 4 is a schematic enlarged view of a lay plate portion.

FIGS. 5(*a*) and (*b*) are schematic front views showing relative positions of sensors and a detection piece.

FIG. 6(*a*) is a schematic vertical sectional view showing an ACTIMA CLAMP as driving means.

FIG. 6(*b*) is a schematic oblique view showing a cam.

DETAILED DESCRIPTION OF THE PREFERRED EMBODIMENTS

Figure 1:
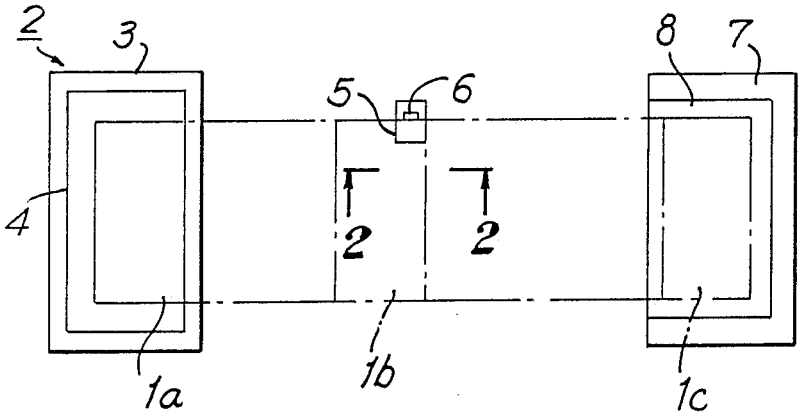
FIG. 1 is a schematic plan view showing a sheet-feed printing machine.
Figure 2:
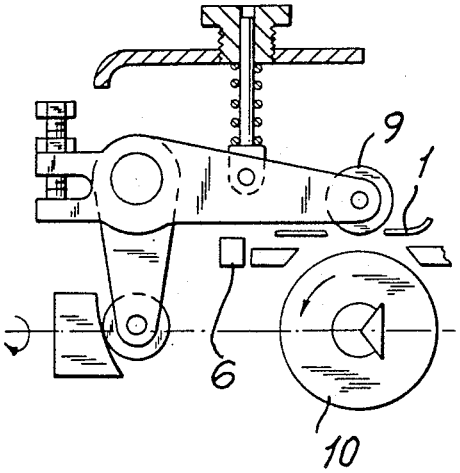
FIG. 2 is a schematic front view of a side register lay of the printing machine.
Figure 3:
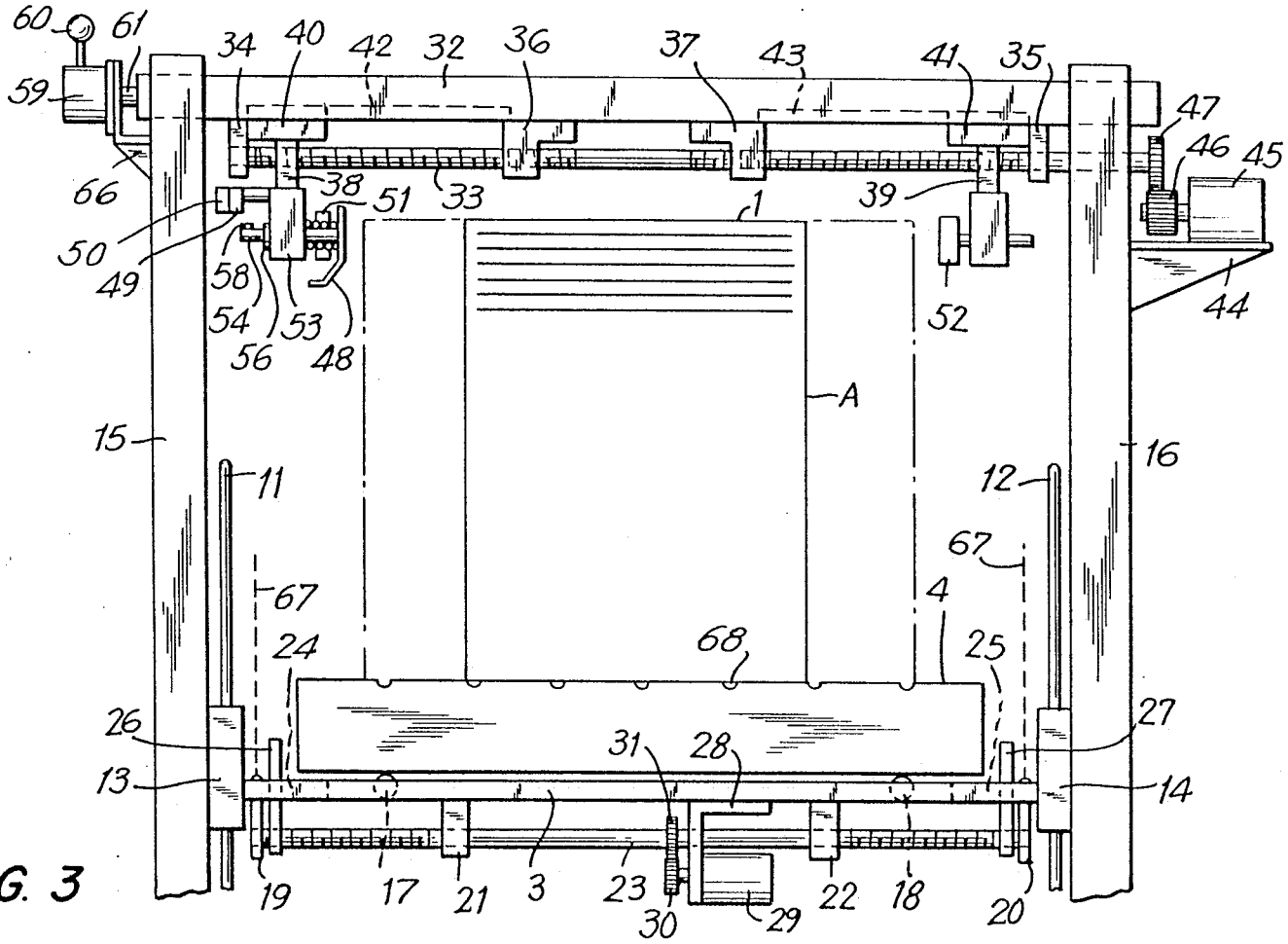
FIG. 3 is a schematic front view showing an embodiment of the present invention.

Preferred embodiments of the present invention will now be described in detail with reference to the drawings. FIG. 3 is a schematic front view of a feeder for a printing machine according to the present invention. Referring to FIG. 1, a paper sheet pile A comprising a stack of paper sheets 1 is placed on a flat-plate-formed pile board 3 or a pallet 4. The pile board 3 is hung down at its four corners by elevator chains 67, and is moved up and down manually or by a motor according to the detection of the top surface of the paper sheet pile A, being guided by guide rods 11 and 12. More specifically, the pile board 3 is fixed at its right and left edges to blocks 13 and 14, and the blocks 13 and 14 penetrate the guide rods 11 and 12. Thus, with the blocks 13 and 14 sliding on the inside surfaces of side frames 15 and 16, the pile board 3 is guided by the guide rods 11 and 12 to move up and down together with the pallet 4 and the paper sheet pile A.

The pallet 4, by rollers 17 and 18 mounted on its bottom surface, can be moved right and left on the pile board 3. Thus, the position of the paper sheet pile A in the right/left (cross or lateral) direction is adjustable. More specifically, on the bottom surface of the pile board 3 is disposed a threaded shaft 23, which is movably supported by bearings 19 and 20 and supporting members 21 and 22 and extending in the cross direction, and the threaded shaft 23 is screwed in the lower ends of claws 26 and 27 penetrating cutouts 24 and 25, which are cut out in the cross direction at both ends of the pile board 3, and extending vertically. The threaded shaft 23 is supplied with a rotational force from a motor 29 mounted by a bracket 28 on the bottom surface of the pile board 3 through gear 30 and 31. Thus, the claws 26 and 27 are moved to the right or the left along the cutouts 24 and 25 according to the rotation of the threaded shaft 23 until one of the claws 26 and 27 comes into contact against the left end surface or the right end surface of the pallet 4, so that the pallet 4 will not go any further.

An electric magnet (not shown) is embedded in the pile board 3 and, when the magnet is energized, it attracts and holds the pallet 3 on the pile board 4. Therefore, before the threaded shaft 23 is rotated to adjust the cross-directional position of the pallet 4, the electric magnet must be de-energized.

A beam 32, at its right and left ends, is supported on the top of the side frames 15 and 16, so that it is movable in the cross direction. A threaded shaft 33 is movably supported by bearings 34 and 35 and supporting members 36 and 37 mounted on the lower surface of the beam 32. The left half of the threaded shaft 33 is provided with a left-handed screw and the right half is provided with a right-handed screw. The top ends of supporting members 38 and 39 are respectively engaged with the left-handed screw portion and the right-handed screw portion of the threaded shaft 33, with the top surfaces of the supporting members 38 and 39 fixed to blocks 40 and 41. The top ends of the blocks 40 and 41 are respectively disposed in grooves 42 and 43 provided on the lower surface of the beam 32, thereby limiting movement of the top ends. Thus, the supporting members 38 and 39 are moved in a direction to approach or separate to the same extent along the threaded shaft 33 according to the rotation of the threaded shaft 33. The rotational force to the threaded shaft 33 is supplied by a motor 45 disposed on a bracket 44 fixed to the side frame 16, through gears 46 and 47. The supporting member 38 has hung on it a lay plate 48, sensors 49 and 50, and an auxiliary blast 51, and the supporting member 39 has hung on it an auxiliary blast 52. The auxiliary blasts 51 and 52 are for blowing air into the paper sheet pile A at its right and left edges.

The lay plate 48 and the sensors 49 and 50 will be described further in detail with reference to FIG. 4 which is an enlarged view of this portion. The lay plate 48 is supported at the right end of a rod 54 which, at its center, is movably supported in the cross direction in the block 53. A spring 55 is provided on the rod 54 between the lay plate 48 and the block 53, and the lay plate 48 is pressed by the force of the spring 55 towards the right in the figure. A stopper 56 is fixed to the rod 54 so that it comes in contact against the left end surface of the block 53, to restrict the movement at the right side of the rod 54. The sensors 49 and 50 are fixed side by side to a supporting rod 57 which is fixed to the left end surface of the block 53 and projecting to the left, so that the sensors 49 and 50 operate when a detection piece 58 mounted at the left end of the rod 54 faces the respective lower surfaces of the sensors 49 and 50. Thus, the sensor 49 operates in the state as shown in FIG. 5(*a*), and the sensors 49 and 50 operate in the state as shown in FIG. 5(*b*).

Referring to FIG. 3, a moving mechanism 59, which is the "ACTIMA CLAMP" (trade name) in this embodiment, is mounted on the side frame 15 through a mount 66. In the moving mechanism 59, a shaft 61 mounted at the left end of the beam 32 is moved to the right and left by turning a lever 60. The moving distance is the distance between a position at which the paper sheet pile A is to be positioned when a left-pulling side register lay is used and a position at which the paper sheet pile A is to be positioned when a right-pulling side register lay is used. Thus, while FIG. 1 shows the case with the right-pulling side register lay, when the left-pulling side register lay is used, the beam 32, the bearings 34 and 35, the threaded shaft 33, the lay plate 48, the auxiliary blast 51, and the sensors 49 and 50 are integrally moved to the right in the figure by turning the lever 60.

Then the lay plate 48, by setting the type (size) of the paper sheet 1, is moved (by energization of motor 45) together with the sensors 49 and 50 from an initial position to a predetermined position (a position at which the left side edge of the paper sheet 1 is positioned so that the paper sheet 1 is normally picked up by or abuts the side register lay 5) according to the rotation of the threaded shaft 33. The amount of the movement is detected by an encoder (not shown) which detects the amount of rotation of the motor 45.

FIGS. 6(*a*) and 6(*b*) are schematics showing the structure of the ACTIMA CLAMP. Referring to FIGS. 6(*a*) and 6(*b*), in the ACTIMA CLAMP, by turning the lever 60, a cam 62 rotates to move a concentric sleeve 63, which is provided in the cam 62, to the right and left. Thus, the the cam 62, as shown in detail in FIG. 6(*b*), has a cutout 64 with a straight groove followed by a slanted groove, and is inserted with a pin 65 projecting from the outer peripheral surface of the sleeve 63. Therefore, when the left end of the shaft 61 is fixed to the sleeve 63, the shaft 61 can be moved right and left according to the rotation of the lever 60.

With the above-described arrangement, by setting the type of the paper sheet 1 prior to the printing operation, the threaded shaft 33 is rotated by the motor 45 to return the supporting members 38 and 39 back to the initial position, and is then moved to a predetermined position. Then, the threaded shaft 23 is rotated by the motor 29 to move the pallet 4 to the left until the left edge of the paper sheet pile A comes in contact against the lay plate 48. When the paper sheet pile A comes in contact, the lay plate 48 moves to the left against the force of the spring 51 and, when the sensor 49 detects the detection piece 58 (in the state as shown in FIG. 5(*a*)), the pallet 4 stops moving. As a result, the left edge of the paper sheet pile A is positioned so that the paper sheet 1 can be properly picked up by the side register lay 5. In this case, the state where the sensors 49 and 50 detect the detection piece 58 (the state as shown in FIG. 5(*b*)) means that the paper sheet pile A is positioned too far left, and the state where none of the sensors 49 and 50 detect the detection piece 58 (the state as shown in FIG. 4) means that the paper sheet pile A is positioned too far right.

When the paper sheet 1 is taken out of the feeder 2 when the sensor is in the state as shown in FIG. 5(*a*), the paper sheet 1 can be properly picked up by the side register lay 5 with correct position control.

If, for example, the paper sheet pile A is skewed and the left edge of the pile is slanted, the position of the left edge relative to the lay plate 48 is varied, and the relative positions of the sensors 49 and 50 and the detection piece 58 are as shown in FIG. 4 or FIG. 5(*b*). When the sensors 49 and 50 detect any of the above two states, the motor 29 is operated to to move the pile 4 to the right or left so that the left edge of the paper sheet pile A is always positioned at a predetermined position.

When, for example, printing on the front surface is completed and the backside of the same paper sheet 1 is to be printed, the pulling direction relative to the side register lay 5 must be changed. This is readily achieved by operating the moving mechanism 59. Thus, by operating the moving mechanism 59, the beam 32 is moved right or left. The amount of the movement is the distance between a position at which the paper sheet pile A is to be positioned when a left-pulling side register lay 5 is used and a position at which the paper sheet pile A is to be positioned when a right-pulling side register lay 5 is used. Thus, when the first printing is carried out with the right-pulling side register lay, the moving mechanism 59 is then operated to move the beam 32 to the right the above-described distance. Associated with the movement of the beam 32, the lay plate 48, together with the sensors 49 and 50 and the threaded shaft 33, is moved in the same direction to the same extent. At this time, the auxiliary blasts 51 and 52 are moved to the same extent in the same direction.

After that, when the left edge of the paper sheet pile A is caused to come in contact against the lay plate 48, the paper sheet 1 can be properly picked up and position-controlled by the side register lay 5.

The above-described embodiment uses the ACTIMA CLAMP as the moving mechanism 59, but it is not limited to the device. Alternatively, any device that can move the threaded shaft 33 to right and left through the beam 32 can be used. Furthermore, in the above-described embodiment, the threaded shaft 33 is moved right and left through the beam 32 but, alternatively, the threaded shaft 33 may be directly moved. In the embodiment, the edge position of the paper sheet pile A is detected by the combination of the lay plate 48 and the sensors 49 and 50. However, the sensors can be used alone (without the lay plate 48) if the sensors can be moved along the threaded shaft 33 and can detect the edge position of the paper sheet pile A.

Figure 7:
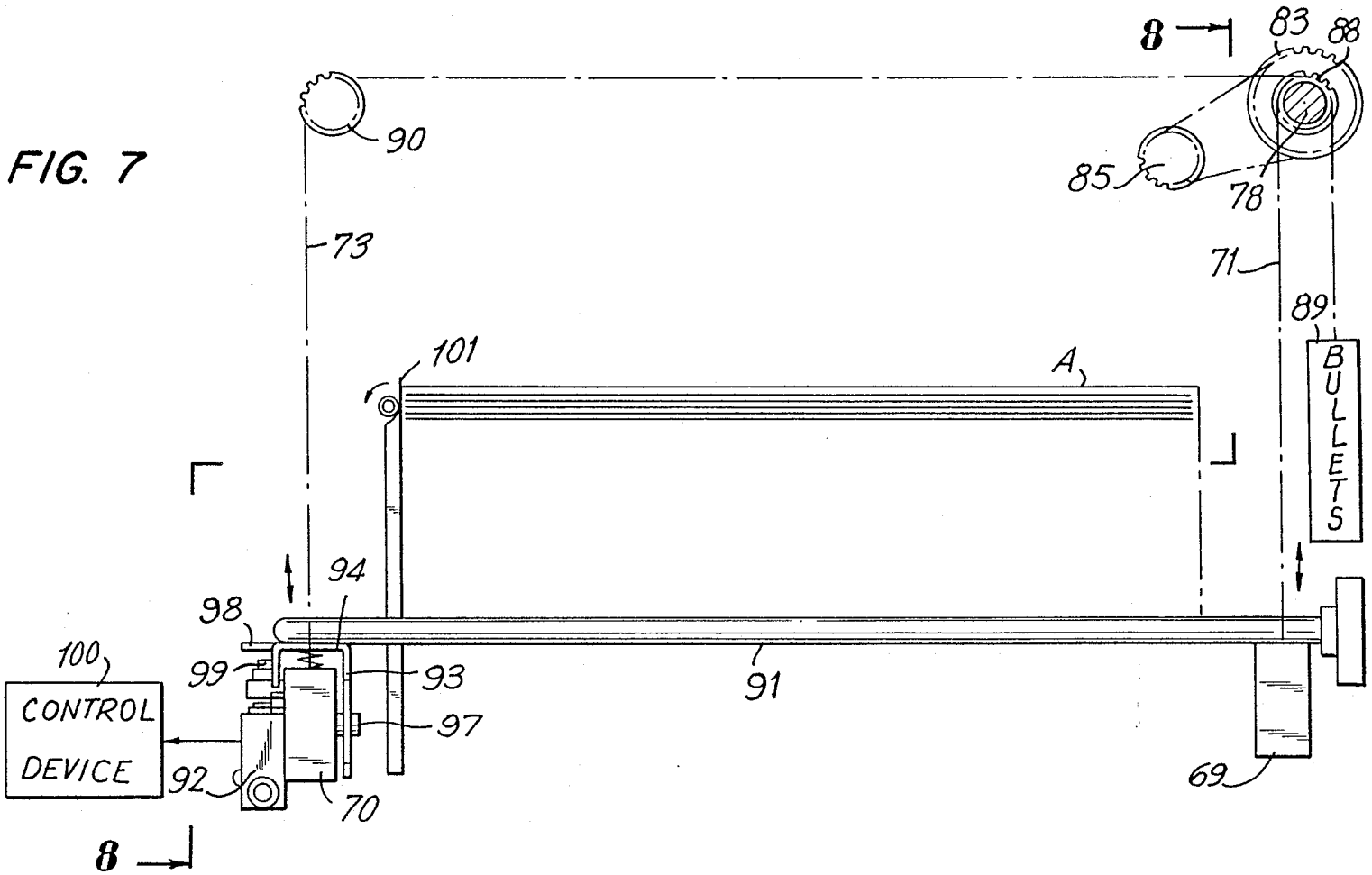
FIG. 7 is a schematic side view showing a non-stop device of the feeder.

Next, a non-stop device of the feeder will be described with reference to FIGS. 7 and 8. In this case, as shown in FIG. 3, a rod-insert groove 63 is formed on the upper surface of the pallet 4 along the paper feed direction. FIG. 7 is a schematic side view and FIG. 8 is a schematic as viewed from the paper discharge side.

Figure 8:
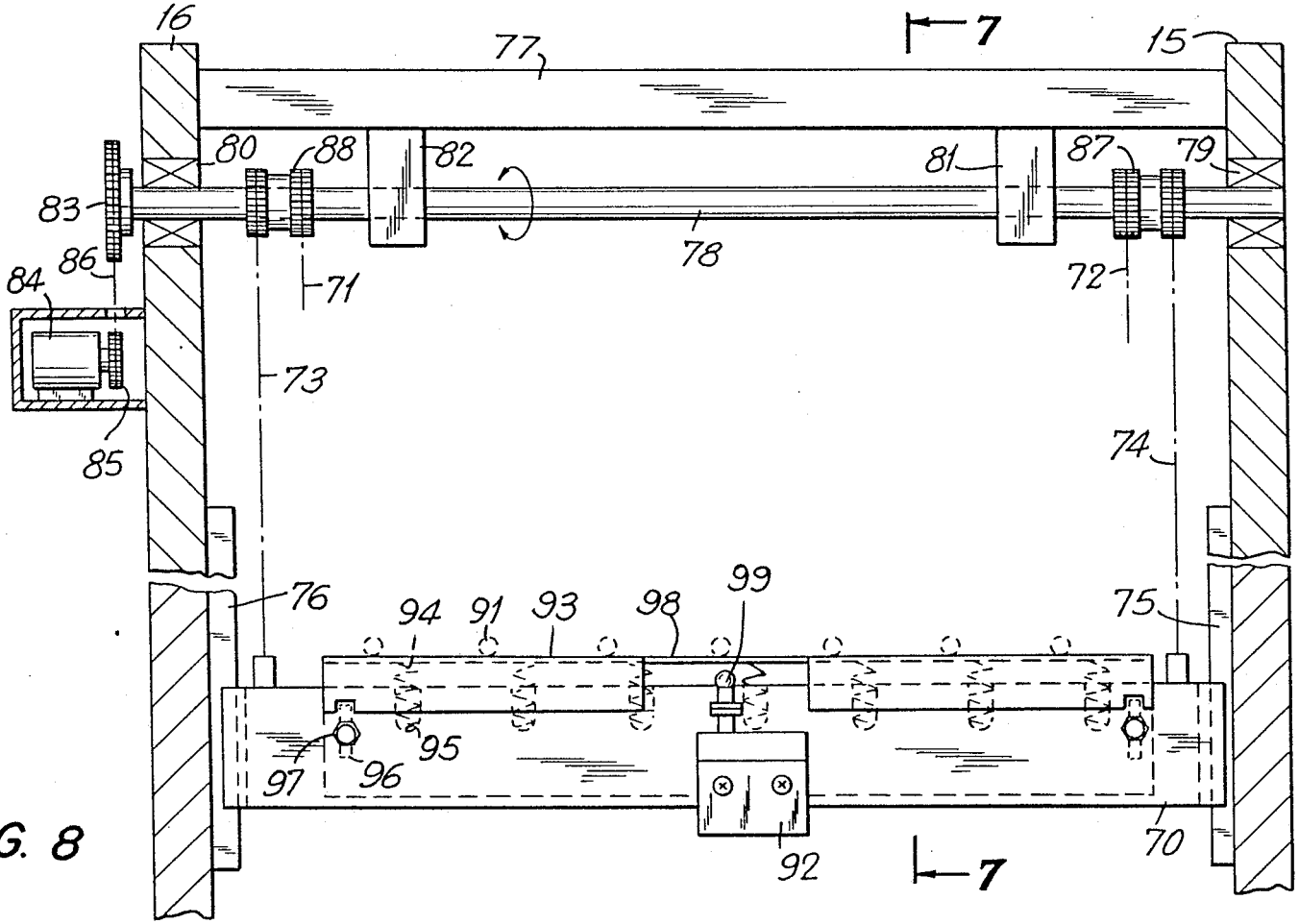
FIG. 8 is a schematic rear view showing the non-stop device.

Referring to FIGS. 7 and 8, a front bar 69 and a rear bar 70 of the non-stop device, at the right and left ends of each, are hung down by elevator chains 71, 72, 73, and 74, and are guided up and down by guide members 75 and 76. More specifically, the guide members 75 and 76 are fixed to the inside surfaces of the side frames 15 and 16, and guide grooves or guide rollers which slide on the guide members 75 and 76 are provided at both ends of each of the bars 69 and 70.

A beam 77 is provided in the cross direction at the upper part between the side frames 15 and 16, and a shaft 78 is rotatably disposed. The shaft 78 is supported by bearings 79 and 80 provided on the side frames 15 and 16, and is also supported by supporting members 81 and 82 which are hung on the beam 78.

A sprocket 83 is fixed to one end of the shaft 78, and a chain 86 is provided between the sprocket 83 and a sprocket 85 which is fixed to the shaft of the non-stop device motor 84. The motor 84 is encased in a box mounted on the side frame 16. Sprockets 87 and 88 are mounted on the shaft 78 at the inside and in the vicinity of the side frames 15 and 16, and the chains 71, 72, 73, and 74 fixed to the bars 69 and 70 are wound around the sprockets 87 and 88, and have bullets 89 provided at the ends of the chains. Thus, both bars 69 and 70 are simultaneously moved up and down by the rotation of the motor 84. A sprocket 90 shown in FIG. 7 is an idler.

The rear bar 70 at the paper discharge side is provided with a microswitch 92 as a sensor for detecting insertion of a rod 91, a U-shaped receiving channel 93, and springs 94 for elastically supporting the receiving channel 93. More specifically, the springs 94 are inserted into holes 95 provided on the upper surface of the bar 70 and, over the springs 94, the bar 70 is covered by the receiving channel 93. The receiving channel 93 is shaped so that it can be moved vertically relative to the bar 70, and the range of movement is determined by the engagement relation between a vertical slot 96 provided in the receiving channel 93 and a bolt 97, which is vertically adjustable, screwed in the bar 70. The microswitch 92 is mounted on side surface of the bar 70, and a part 98 of the receiving channel 93 is cut open perpendicularly to form a detection piece. Numeral 99 indicates an actuator of the microswitch 92, and numeral 101 indicates a paper stop.

Thus, the motor 84 is controlled to move the bars 69 and 70 down to below the pallet 4, when the rod 91 is inserted into the lower side of the paper sheet pile A through the groove 68 (FIG. 3) of the pallet 4. When the non-stop device is operated and the motor 84 is controlled to move up the bars 69 and 70, one end of the rod 91 come in contact against the receiving channel 93. When, from this state, the bars 69 and 70 are moved up further, the receiving channel 93 is moved down by the weight of the paper sheet pile A. As a result, the detection piece 98 of the receiving channel 93 presses the actuator 99 of the microswitch 92, and thus the insertion of the rod 91 is detected.

A detection signal is applied from the microswitch 92 to a control device 100, and the control device 100 stops paper edge detection of the paper edge detecting sensors 49 and 50 to stop the automatic cross-direction movement of the pallet 4. However, the control device 100 is designed to enable manual operation to rotate the motor 29 forward and reverse, or the pallet 4 to be moved manually in the cross direction.

With this condition, the pile board 3 together with the pallet 4 is moved down and a new paper sheet pile A (auxiliary pile) is loaded, then the position in the cross direction of the pallet 4 is adjusted manually, and the auxiliary pile is combined with the paper sheet pile (main pile) on the rod 91 of the non-stop device. The auxiliary pile is combined with the main paper pile A by moving up the auxiliary pile until its top surface comes in contact against the bottom surface of the main paper pile A on the rods 91.

When the rod 91 is removed, the weight of the main pile is transferred to the pallet 4, the detection piece 98 of the receiving channel 93 is separated from the actuator 99 of the microswitch 92 by the force of the spring. As a result, removal of the rods 91 is detected and, receiving a signal from the microswitch 91, the control device 100 restarts paper edge detection by the paper edge detecting sensors 49 and 50. The motor 29 rotates forward or reverse to automatically adjust the position in the cross direction of the paper sheet pile.

Figure 9:
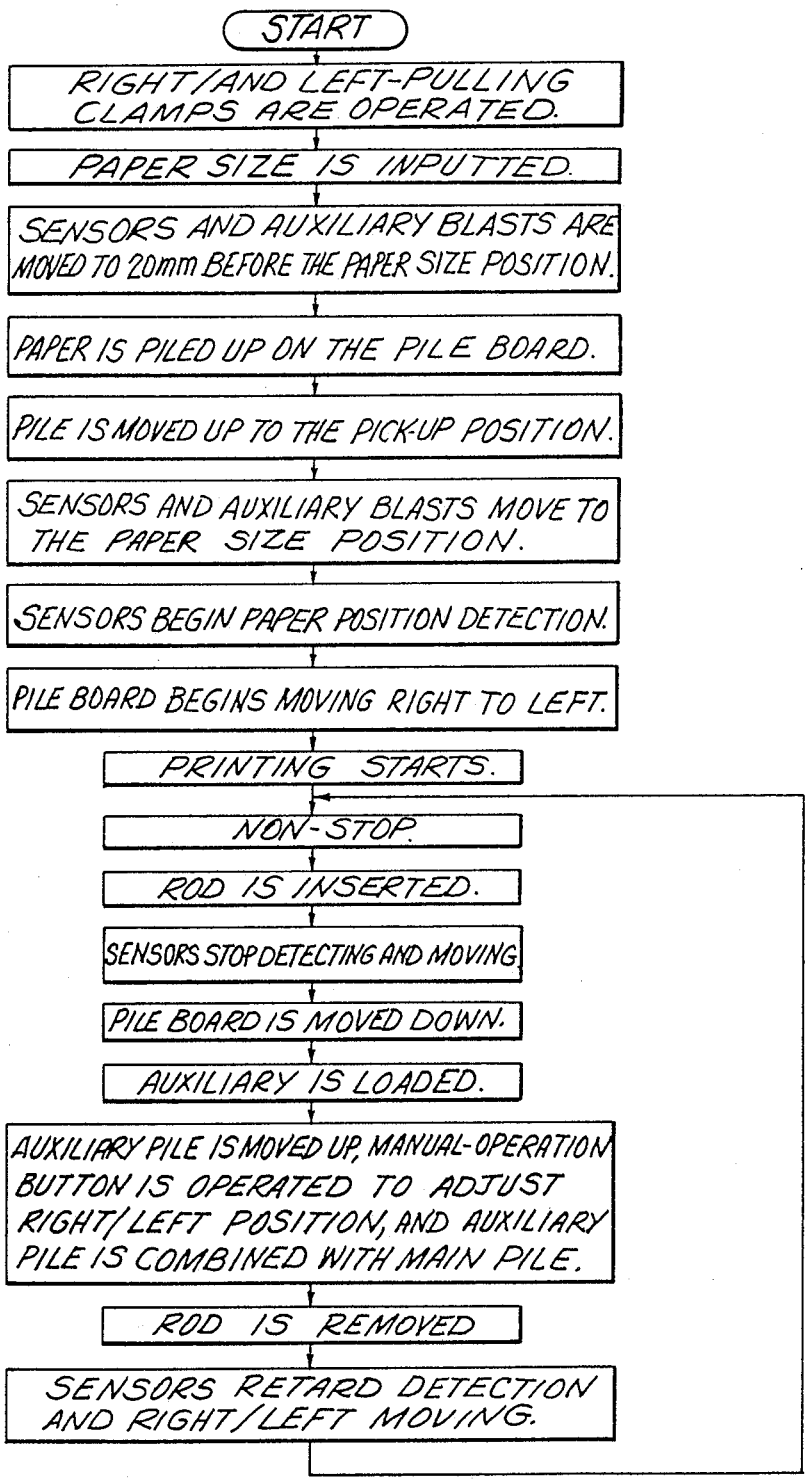
FIG. 9 is a flow diagram of the operation of the feeder.

FIG. 9 is a flow diagram showing the above-described operations.

Figure 10:
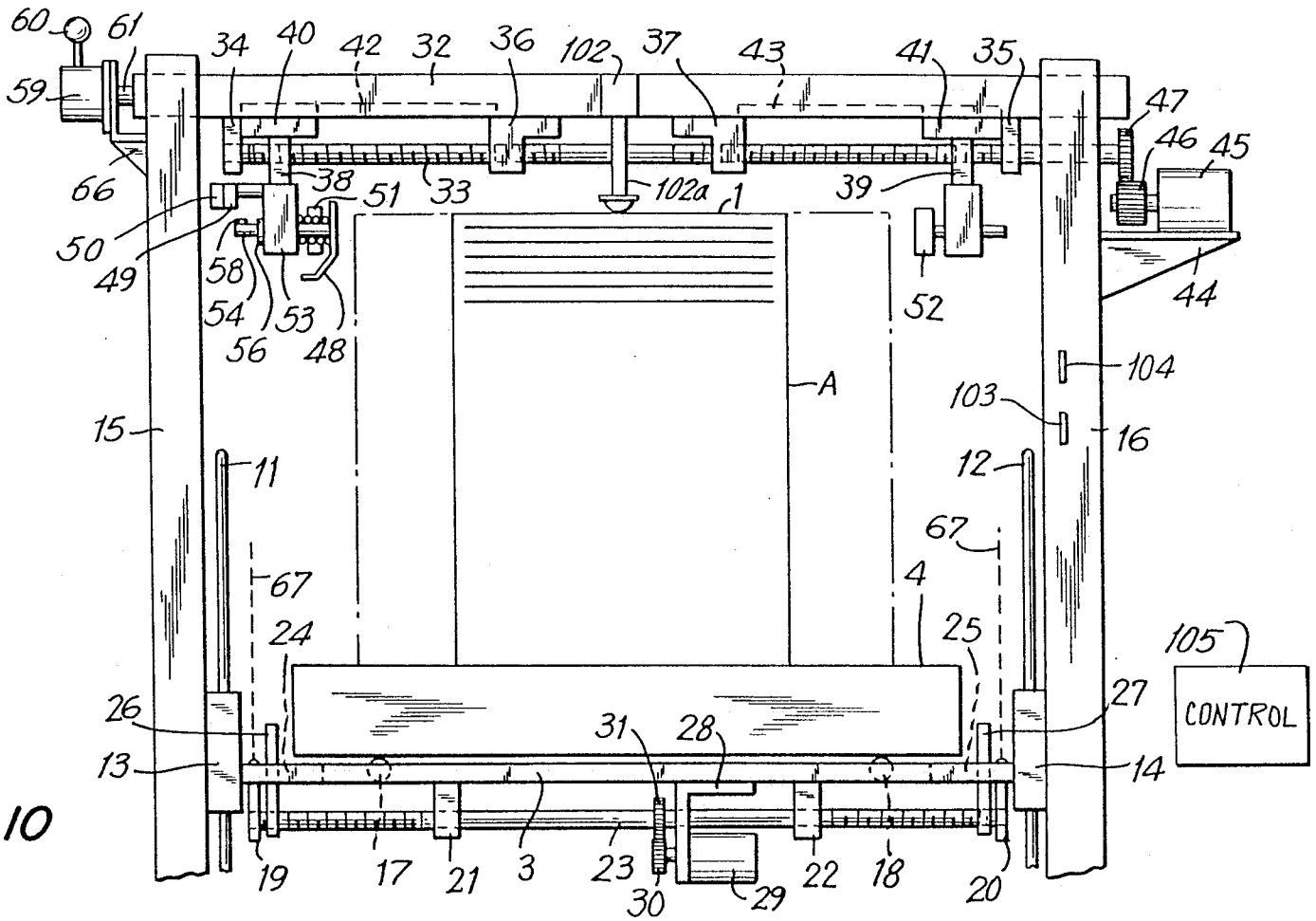
FIG. 10 is a schematic front view showing another embodiment of the present invention.
Figure 11:
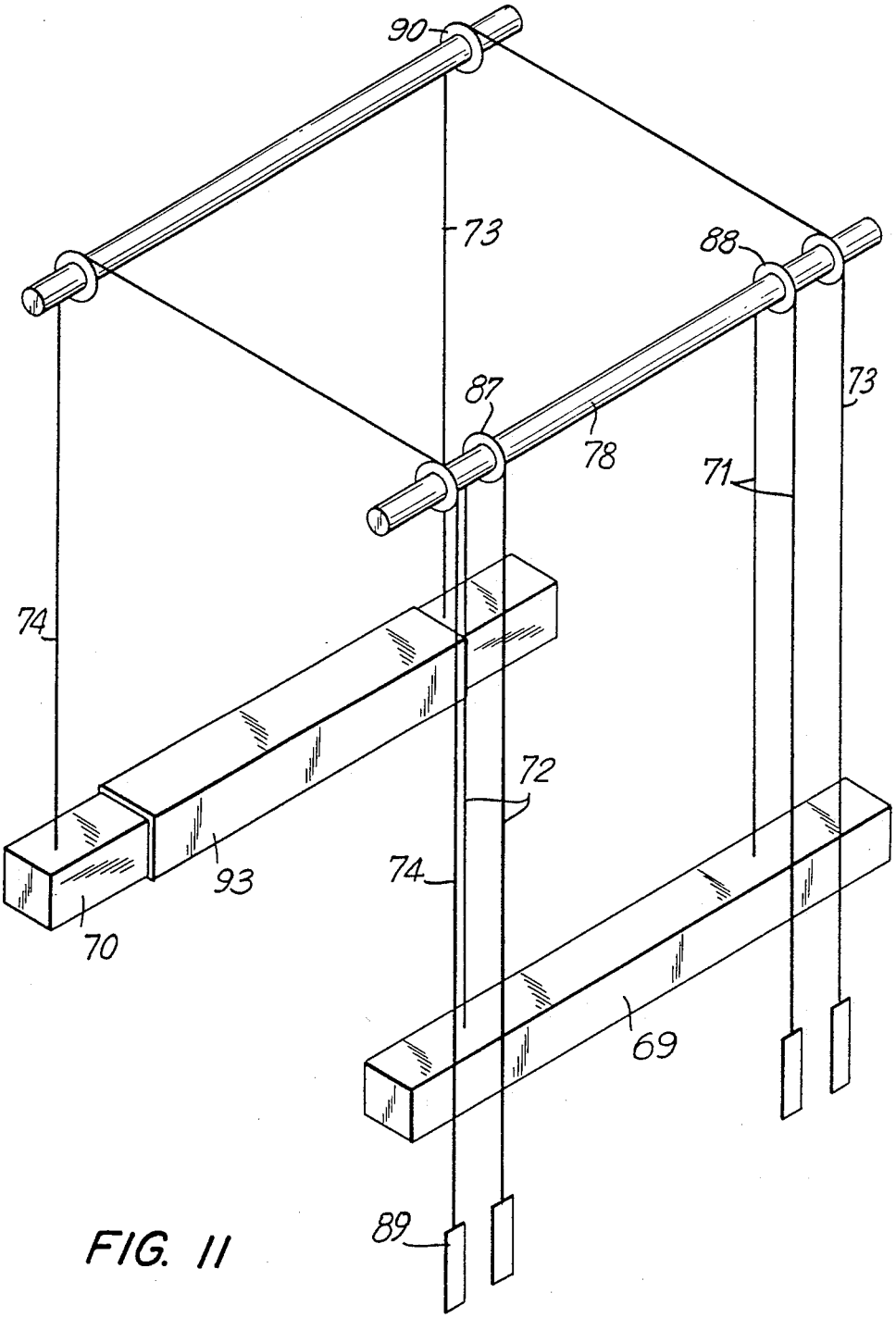

FIG. 10 is a schematic front view showing another embodiment of the feeder for a sheet-feed printing machine according to the present invention. In the figure, same parts as used in the previous embodiment are indicated with the same numerals, with repeated description omitted.

Referring to FIG. 10, a beam 32 is provided at its center with a microswitch (pile top-surface detecting sensor) 102, and a detecting rod 102*a* of the microswitch 102 opposes the top surface of a pile A. A side frame 16 has proximity sensors 103 and 104. The proximity sensors 103 and 104 are to detect block 14. Detection of the block 14 by the proximity sensor (remaining paper detecting sensor) 103 indicates that the pile board 3 approaches the upper limit position and that the remaining amount of the paper sheets 1 is below a specified level. Detection of the block 14 by the proximity sensor 104 indicates that the pile board 3 reaches the upper limit position and where there are no longer any paper sheets 1 on the pallet 4.

A control unit 105 receives detection signals from sensors 49 and 50, the microswitch 102, and the proximity sensors 103 and 104, and controls motors 29 and 45 and other components.

Operation of the feeder for the sheet-feed printing machine will now be described. The pile board 3 moves up as the paper sheets 1 are fed to the printing machine, and a lay plate 48 of the sensor unit is in contact against an edge of the pile A. At this time, the sensors 49 and 50 detect a detection piece 58 and, in turn, the edge of the pile A. The control unit 105 determines the edge position of the pile A based on the detection signals from the sensors 49 and 50, and controls the position in the cross direction of the pallet 4 by controlling the motor 29 so that the edge of the pile is at a predetermined position.

When the remaining amount of the paper sheets 1 on the pallet 4 becomes small to an extent that the pile A does not slant, the pile board 3 approaches the upper limit position, and the proximity sensor 103 detects the block 14. The control unit 105, when the proximity sensor 103 detects the block 14, controls the rotation of the motor 45 so that supporting members 38 and 39 move away from one another. As a result, the lay plate 48 and the sensors 49 and 50 of the sensor unit and auxiliary blasts 51 and 52 are withdrawn from the side edges of the pile A to near the side frames 15 and 16.

When the pile board 3 goes up further to the upper limit position and the paper sheets 1 on the pallet 4 are completely fed out, the proximity sensor 104 detects the block 14. After the proximity sensor 104 detects the block 14, the pile board 3 is moved down from the upper limit position to the lower limit position.

The pile board 3, when it reaches the lower limit position, is loaded with a new pile A through the pallet 4. The pile board 3 is then moved up gradually and stopped at a position where the detection rod 102*a* of the microswitch 102 comes in contact against and detects the top surface of the pile A. Now, the top surface position of the pile A is in line with the paper feed position. The control unit 105, when the microswitch 102 detects the top surface of the new pile A. controls the motor 45 to bring the supporting members 38 and 39, which have been withdrawn to the side frames 15 and 16, closer to one another to the correct paper size position. This causes the lay plate 48 of the sensor unit to come in contact against the side edge of the new pile A and the auxiliary blasts 51 and 52 to approach the side edges of the pile A. Then, feeding of paper sheets 1 to the printing machine is restarted. Of course, as the paper sheets 1 are fed to the printing machine, the pile board 3 is moved up, and the position of the pallet 4 is adjusted according to the detection signals from the sensors 49 and 50 of the sensor unit to regulate the edge at the top position of the pile A to the desired lateral position.

When the pile A is first loaded on the pile board 3, the sensor unit (the lay plate 48 and sensors 49 and 50) and the auxiliary blasts 51 and 52 are withdrawn.

As described above, since, with the present invention, the sensor unit and the auxiliary blasts are withdrawn, a new pile will never push up the sensor unit and auxiliary blasts, thus preventing the sensor unit and the auxiliary blasts from any damage.

As described above in detail with reference to the embodiments, the present invention can accommodate left-pulling and right-pulling operation with a single device which registers the position of a single edge in the cross direction of the paper sheet pile, thereby enabling simple structure of the device, reducing the number of parts, and providing a reduction in cost.

Moreover, the feeder according to the present invention enables automatic positioning of the side edges in the lateral direction of the paper sheet pile and non-stop paper feed operation.

Further, with the present invention, since the sensor unit to detect the side edge of the pile is withdrawn away from the pile during the time from when the remaining paper amount of the foregoing pile becomes small until the next pile is loaded and the top surface of the pile reaches the paper feed position, the new pile will not hit the sensor unit. Thus, sensor unit is prevented from being damaged, and detection of the side edge of the pile by the sensor unit is properly performed.

I claim:

1. A feeder for a sheet-feed printing machine having a pallet on a pile board loaded with a paper sheet pile movable to the right and left in a direction lateral to the feed direction to feed paper sheets and for moving up said pile board to a printing unit through a side register lay, comprising;

a threaded shaft extending in a direction lateral to the feed direction, a first sensor means movable along said threaded shaft in the lateral direction in response to rotation of said threaded shaft to detect a side edge of said paper sheet pile, and a moving mechanism to move said first sensor means together with said threaded shaft in the lateral direction in an amount equal to the distance between a position at which said paper sheet pile is to be positioned when a left-pulling side register lay is used and a position at which said paper sheet pile is to be positioned when a right-pulling side register lay is used.

2. A feeder for a sheet-feed printing machine as claimed in claim 1, further comprising a beam supported at its both ends on the top of right and left side frames and being movable in the horizontal direction, wherein said threaded shaft is rotatably supported on said beam through bearings and supporting members.

3. A feeder for a sheet-feed printing machine capable of feeding paper sheets of different widths and having a pallet on a pile board loaded with a paper sheet pile movable to the right and left in a direction lateral to the feed direction to feed paper sheets and for moving up said pile board to a printing unit through a side register lay, comprising;

an automatic lateral position control mechanism disposed above said pile board along the lateral direction having a rotatable threaded shaft and a means coupled thereto to rotate said threaded shaft, a first sensor means, disposed movably along said threaded shaft according to the rotation of said threaded shaft, and disposed against the upper lateral sides of said paper sheet pile for detecting the position of a side edge of said paper sheet pile on said pile board, paper sheet position adjusting means for moving said pallet on said pile board in the right and left directions in response to a detection signal from said first sensor means to adjust the position of the paper sheets, a remaining paper sheet detecting sensor means for detecting reduction in amounts of remaining original paper sheets on said pile board, a pile top surface detecting sensor means for detecting, as said pile board loaded with a new paper sheet pile is moving up, the top surface of said new paper sheet pile reaching a predetermined position, and control means for controlling said automatic lateral position control mechanism so that, when said remaining paper sheet detecting sensor means detects a reduction in the amount of paper sheets, said first sensor means is separated from the side edge of said paper sheet pile and that, when said pile top surface detecting sensor means detects that the top surface of said new paper sheet pile reaches a predetermined position, said first sensor means is moved to a position where said first sensor means can detect the side edge of said paper sheet pile.

4. A feeder for a sheet-feeding printing machine as claimed in claim 3, further comprising, a pile board moving means for moving said pile board so that a new paper pile is stacked thereon and then moved to a paper feed position.

5. A feeder for a sheet-feed printing machine having a pallet on a pile board loaded with a paper sheet pile movable to right and left in a direction lateral to the feed direction to feed paper sheets and for moving up said pile board to a printing unit through a side register lay, comprising; an automatic lateral position control mechanism disposed above said pile board along the lateral direction having a rotatable threaded shaft and a means coupled thereto to rotate said threaded shaft, a first sensor means, provided on a member movable along said threaded shaft according to the rotation of said threaded shaft, for detecting the position of a side edge of said paper sheet pile, paper sheet position adjusting means for moving said pallet on said pile board right and left in response to a detection signal from said first sensor means to adjust the position of the paper sheets, non-interrupting paper replenishing means comprising, a rod inserted under the bottom surface of said paper sheet pile through a groove of said pallet and loaded on said rod, a second sensor means for detecting insertion of said rod, and control means for interrupting operation of said paper sheet position adjusting means while said second sensor means is detecting inserting of said rod.

6. A feeder for a sheet-feed printing machine as claimed in claim 5 wherein said non-interrupting paper replenishing means further comprises;

auxiliary pile moving means for moving said auxiliary pile upward so that its top surface contacts the bottom surface of said paper sheet pile under said rod, and vertical moving means for vertically moving said paper replenishing means independently of vertical movement of said pile board and said pallet.

7. A feeder for a sheet-feed printing machine having a pallet on a pile board loaded with a paper sheet pile movable to the right and left in a direction lateral to the feed direction to feed paper sheets and for moving up said pile board to a printing unit through a side register lay, comprising;

a threaded shaft extending in a direction lateral to the feed direction, a first sensor means movable along said threaded shaft in the lateral direction in response to rotation of said threaded shaft to detect an edge of said paper sheet pile, a moving mechanism to move said first sensor means together with said threaded shaft in the lateral direction an amount equal to the distance between a position at which said paper sheet pile is to be positioned when a left-pulling side register lay is used and a position at which said paper sheet pile is to be positioned when a right-pulling side register lay is used, paper sheet position adjusting means for moving said pallet on said pile board right and left in response to a detection signal from said first sensor means to adjust the position of the paper sheets, non-interrupting paper replenishing means comprising, a rod inserted under the bottom surface of said paper sheet pile through a groove of said pallet and loaded on said rod, a second sensor means for detecting insertion of said rod, and control means for interrupting operation of said paper sheet position adjusting means while said second sensor means is detecting insertion of said rod.

8. A feeder for a sheet-feed printing machine as claimed in claim 7 wherein said non-interrupting paper replenishing means further comprises;

auxiliary pile moving means for moving said auxiliary pile upward so that its top surface contacts the bottom surface of said paper sheet pile under said rod, and vertical moving means for vertically moving said paper replenishing means independently of vertical movement of said pile board and said pallet.

9. A feeder for a sheet-feed printing machine having a pallet on a pile board loaded with a paper sheet pile movable to the right and left in a direction lateral to the feed direction to feed paper sheets and for moving up said pile board to a printing unit through a side register lay, comprising;

a threaded shaft extending in a direction lateral to the feed direction, a first sensor means along said threaded shaft in the lateral direction in response to rotation of said threaded shaft to detect a side edge of said paper sheet pile, a moving mechanism to move said first sensor means together with said threaded shaft in the lateral direction in an amount equal to the distance between a position at which said paper sheet pile is to be positioned when a left-pulling said register lay is used and a position at which said paper sheet pile is to be positioned when a right-pulling side register lay is used, a remaining paper sheet detecting sensor means for detecting reduction in amounts of remaining original paper sheets on said pile board, a pile top surface detecting sensor means for detecting, as said pile board loaded with a new paper sheet pile is moving up, the top surface of said new paper sheet pile reaching a predetermined position, and control means for controlling rotation of said threaded shaft so that, when said remaining paper sheet detecting sensor means detects a reduction in the amount of paper sheets, said first sensor means is separated from the side edge of said paper sheet pile and that, when said pile top surface detecting sensor means detects that the top surface of a new paper sheet pile reaches a predetermined position, said first sensor means is moved to a position where said first sensor means can detect the side edge of said paper sheet pile.

* * * * *